United States Patent [19]

Hintsa

[11] Patent Number: 4,548,010

[45] Date of Patent: Oct. 22, 1985

[54] CONCEALED SUSPENDED CEILING SYSTEM

[75] Inventor: Roy A. Hintsa, Etobicoke, Canada

[73] Assignee: Decoustics Limited, Rexdale, Canada

[21] Appl. No.: 523,784

[22] Filed: Aug. 17, 1983

Related U.S. Application Data

[63] Continuation-in-part of Ser. No. 277,166, Jun. 25, 1981, Pat. No. 4,438,613.

[51] Int. Cl.[4] ..... E04B 5/52

[52] U.S. Cl. ..... 52/484; 52/489; 52/804; 52/822

[58] Field of Search ..... 52/28, 144, 484–489, 52/655, 656, 716, 717, 718, 779, 801, 802, 804, 813, 821, 822; 160/380; 49/463–466

[56] References Cited

U.S. PATENT DOCUMENTS

| | | | |
|---|---|---|---|
| 2,065,796 | 12/1936 | Davis | 52/485 |
| 2,101,349 | 12/1937 | Sharp | 52/656 |
| 2,459,121 | 1/1949 | Willey et al. | 52/144 |
| 2,616,197 | 11/1952 | Osburn | 52/813 |
| 2,843,889 | 7/1958 | Keller | 52/822 |
| 3,000,474 | 9/1961 | Friedman | 52/484 |
| 3,089,570 | 5/1963 | O'Neil, Sr. | 52/484 |
| 3,139,162 | 6/1964 | Spangenberg | 52/484 |
| 3,225,503 | 12/1965 | Rallis | 52/712 |
| 3,279,139 | 10/1966 | Stahlhut | 52/779 |
| 3,430,338 | 3/1969 | Flaherty | 29/839 |
| 3,513,613 | 5/1970 | Jones et al. | 52/779 |
| 3,696,571 | 10/1972 | Schluter | 52/144 |
| 4,004,390 | 1/1977 | Merkwitz | 52/484 |
| 4,019,300 | 4/1977 | Sauer et al. | 52/665 |
| 4,027,446 | 6/1977 | Brugman | 52/484 |
| 4,057,947 | 11/1977 | Oide | 52/779 |
| 4,089,146 | 5/1978 | Martinez | 52/484 |
| 4,438,613 | 3/1984 | Hintsa et al. | 52/813 |

FOREIGN PATENT DOCUMENTS

| | | | |
|---|---|---|---|
| 696145 | 10/1964 | Canada . | |
| 697832 | 11/1964 | Canada . | |
| 600111 | 12/1959 | Italy | 52/211 |
| 338585 | 8/1959 | Switzerland | 52/144 |

*Primary Examiner*—John E. Murtagh
*Assistant Examiner*—Andrew J. Rudy

[57] ABSTRACT

An improved ceiling panel for use in concealed suspension is disclosed which includes framing a panel body member on the sides and rear face thereof in a manner that the lower surface of the panel is determined by the metal framing members. These members are preferrably extruded aluminum and hence the accuracy thereof and hence the accuracy of the lower surface of the panel can be maintained in a closer tolerance range. In addition the framing members include an inwardly directed flange which preferrably is held by an adhesive within an appropriately located kerfed recess in the edge of the body member. This structure serves to stiffen the panel and reduce deflection thereby providing a ceiling system of substantially improved quality. Height variations in ceiling systems are easily recognized and the present disclosure teaches a system of high quality while providing a system which is easy to install and has the advantages of ready access to the area above the ceiling.

47 Claims, 11 Drawing Figures

FIG. 3.
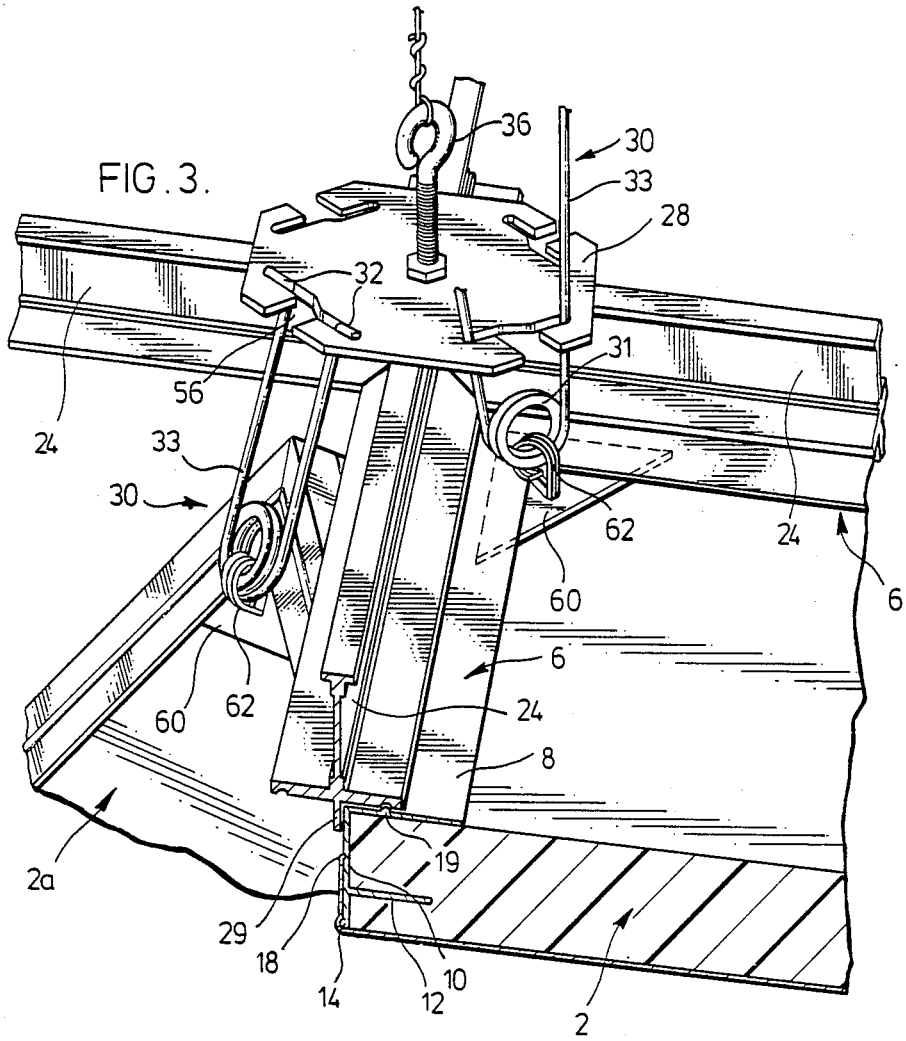
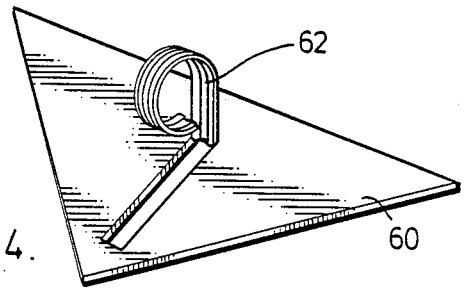
FIG. 4.

FIG. 5.
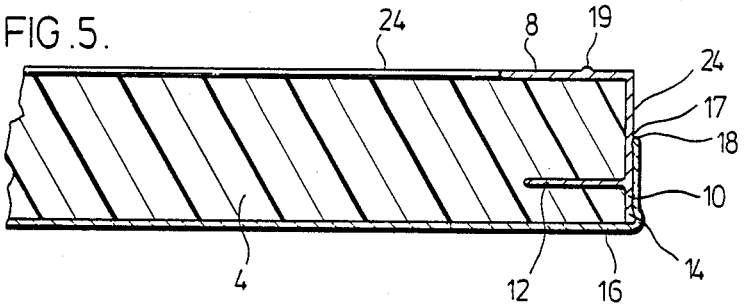
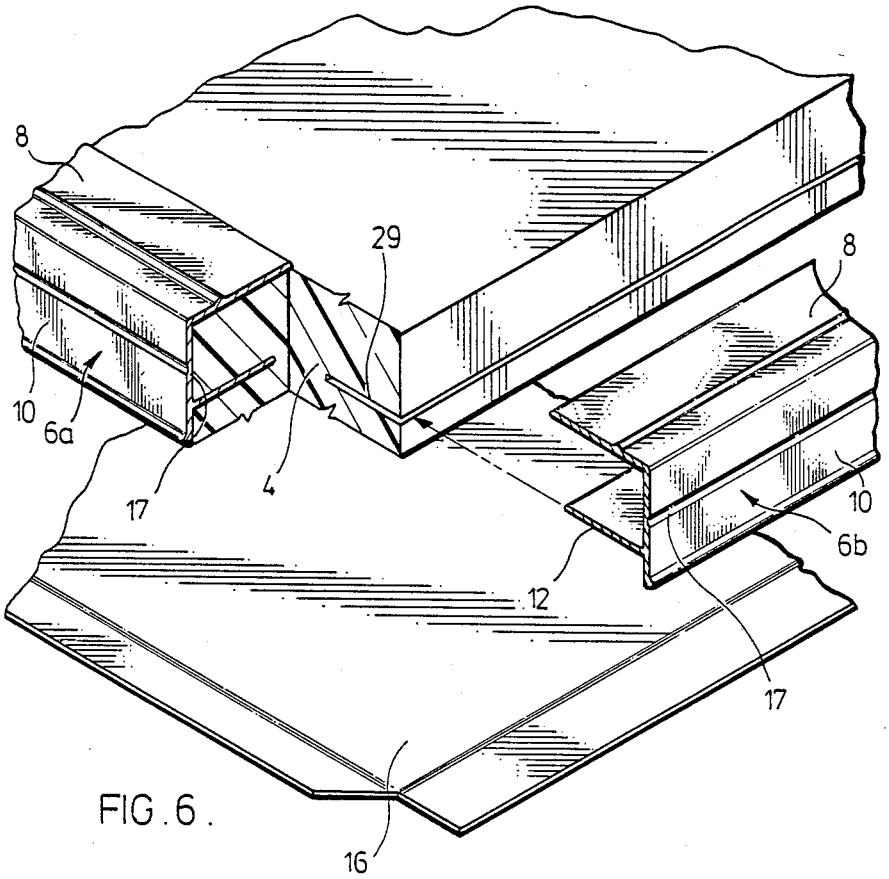
FIG. 6.

CONCEALED SUSPENDED CEILING SYSTEM

This is a continuation in-part application of U.S. application Ser. No. 277,166 filed June 5, 1981, now U.S. Pat. No. 4,438,613.

FIELD OF THE INVENTION

The present invention relates to suspended ceiling systems which allow access to the area above the ceiling. In particular, the invention relates to concealed suspension ceiling systems having a structure which simplifies installation of individual ceiling panels and wherein improved reinforced panels are used to provide a system having improved alignment of individual panels and improved control of the positioning of the panel beneath the grid members.

BACKGROUND OF THE INVENTION

Many suspended ceiling systems have been proposed and are used extensively in building construction to improve the overall appearance of the office space, to allow access to the area above the ceiling where mechanical equipment and piping is often located, and to improve the acoustics of the space. Systems of this general type would include U.S. Pat. No. 2,101,349, U.S. Pat. No. 2,065,796, U.S. Pat. No. 3,430,338, U.S. Pat. No. 4,004,390, U.S. Pat. No. 4,027,446, U.S. Pat. No. 2,616,197, U.S. Pat. No. 3,279,139, U.S. Pat. No. 3,513,613, U.S. Pat. No. 4,019,300, Canadian Pat. No. 696,145 and Canadian Pat. No. 697,832. A suspended ceiling system is also disclosed in our pending Canadian Application Ser. No. 379,053 which corresponds to U.S. patent application Ser. No. 277,166 which are both assigned to the Applicant of the present application.

The problem with the prior art structures is that the main thrust, generally speaking, has been to provide a fairly simple inexpensive suspended ceiling system for use in a variety of applications, however, these systems although inexpensive are certainly not as attractive as a plastered ceiling. The earlier patents generally use what is referred to as a non-concealed system in that the individual grid members used to support the ceiling panels are exposed to the lower surface and as such are visible. More recently concealed ceiling panel systems have been proposed wherein the panels cover the individual grid support network and this is accomplished by having adjacent panels abut in one fashion or another. Generally, concealed ceiling systems are more expensive and therefore the quality of the system is superior. Several major problems occur with concealed ceiling systems, such as:

1. alignment of the edges of the panels to provide straight lines in both the length and width of the ceiling system;
2. control of the level of the individual panels beneath the grid work within a fairly narrow range as variation in the height of the panels is easily recognized from beneath due to light variations; and
3. an adequate air seal between the support grid and the ceiling panels.

The present invention is designed to alleviate the above problems of concealed suspended ceiling systems.

SUMMARY OF THE INVENTION

A ceiling panel for use with a suspended ceiling system, according to the present invention, comprises a body member of acoustical dampening material having at least one planar surface and having straight edges about the periphery thereof, generally perpendicular to the planar surface. L-shaped framing members are secured to the side of the body member to overlie a portion of the top of the panel and abut the side edges thereof. Each frame member includes an inwardly directed planar projection snuggly received within a kerf provided in the side of the body member. The frame member is bonded to the body member by an adhesive securing the projection within the kerf whereby this framed member, when secured to a body member, cooperates with the body member to stiffen the panel. It is important to have a relatively stiff panel as otherwise the panel will undergo substantial deflection due to its own weight and thus a noticeable variation in the height of the ceiling beneath the grid members will occur. Furthermore, such a reinforced panel has the periphery thereof bounded with the framing members whereby damage to the edge of the panel is minimized.

According to an aspect of the invention, the ceiling panel for use in a suspended ceiling system comprises a rectilinear flat body member of a thickness of between ½" to 2" and includes a plurality of extruded aluminum members to be applied to the periphery of the body member to bound the body member and protect the edge thereof. The body member is kerfed about the periphery intermediate the top and bottom surfaces of the panel to define a recess generally parallel to the lower surface of the body member. Each extruded aluminum member has a first arm and a second arm secured to form a right angle. The first arm includes a thin inwardly directed flange generally parallel to the second arm whereby the members, when applied to the edge of the body member, are secured thereto by an adhesive securing the flange within the kerf. When secured, the first arm is in engagement with the periphery of the body member and the second arm overlies and is in contact with the upper edge of the body member about the periphery thereof.

According to an aspect of the invention, the body member is of a thickness to lie within the frame whereby the planar surface of the body member is approximately coplanar with the plane defined by the lower edge of the first arms of said frame members whereby the lower edges of said first arms determine the lower surface of the panel.

According to a further aspect of the invention, a suspended ceiling system comprises a plurality of grid support members, a plurality of ceiling panels each having a body member and a reinforcing edge secured about the top edge of the panel and extending down the side edge thereof, spring means hingedly secured to each of the panels and releasably secured to one of the grid members, wherein the spring means maintains the panel in position against the grid members in one position and in a second position the spring means is selectively disengageable for suspending a ceiling panel system generally perpendicular to the grid members. The reinforcing edge includes a thin inwardly direct flange generally parallel to the top edge of the panel which is received within a kerfed recess in the edge of the body member. The reinforcing edge is secured to the body member by an adhesive applied to the flange prior to securement within the kerfed recess.

The panels of the preferred embodiment of the invention are rectangular and have four torsion springs secured thereto by clips engaging the corners of the panels. With this arrangement, the panels may be lowered and the torsion springs can selectively be disengaged from the grid system to allow hanging of the lowered panel, generally perpendicular to the grid system, along any edge of the panel or from any corner thereof.

According to yet a further aspect of the invention, a particular arrangement for securing and supporting the structural members defining the grid is provided which includes a plate member, which cooperates with a junction member designed to receive the structural members, wherein the plate and the junction member cooperate to position and secure the structural members in a manner whereby the lower extreme of the individual structural members define a plane when the junction members are properly suspended.

BRIEF DESCRIPTION OF THE DRAWINGS

Preferred embodiments of the invention are shown in the drawings wherein;

FIG. 3 is a partial perspective view showing one junction point of the grid system with the various structural members secured and one panel shown in position beneath the grid system and a second panel suspended below the grid system generally perpendicular thereto;

FIG. 4 is a perspective view of the corner clip used in the suspension of a panel beneath the grid network;

FIG. 5 is a sectional view through a panel showing the reinforcing edge member secured within the body member of the panel with a cloth covering applied to the lower surface of the panel and about the side edges thereof;

FIG. 6 is a partial perspective cut away view of a panel with the reinforcing edge members applied about the periphery thereof with a cloth cover about to be applied to the lower surface of the panel (the corner of the panel has been removed to illustrate the securement of the edge member to the body of the panel);

DETAILED DESCRIPTION OF THE PREFERRED EMBODIMENTS

Figure 1:
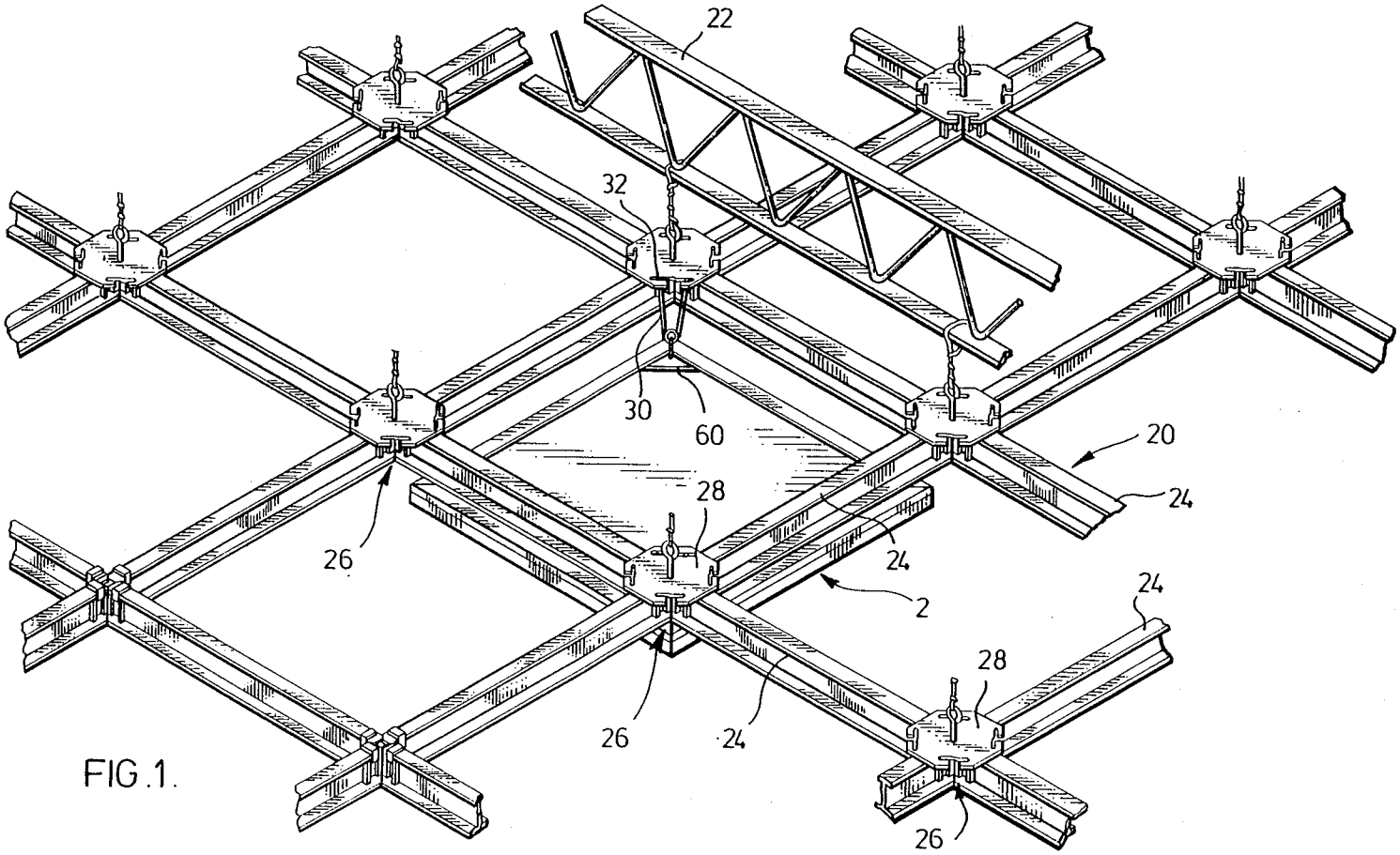
FIG. 1 is a perspective view of the grid system with one panel suspended below the grid system prior to being secured to define a portion of the finished ceiling.

The ceiling panel system of FIG. 1 shows a panel 2, suspended below the grid network 20 which is suspended from structural support members, one of which is shown as 22. The grid network 20 is rectilinear and each cell of the grid network is generally defined by four structural members generally identified as 24 interconnected at the corners thereof by junction members 26 having a plate member 28 secured atop the junction members. Panel 2 is secured beneath the grid network by torsion springs 30 secured at the corners of the rectangular panel 2. As shown in FIG. 1, the legs of the torsion spring have outwardly extending tabs 32 which engage a slot provided in the plate member 28 and therefore determine one position of the panel generally below the grid network in preparation for final positioning beneath the grid members. Therefore the panel is secured by clip members 60 in combination with torsion springs 30 provided at the corner of the ceiling panels with these torsion springs engaging a plate member provided above the grid network at each corner cell of the grid system.

Figure 2:
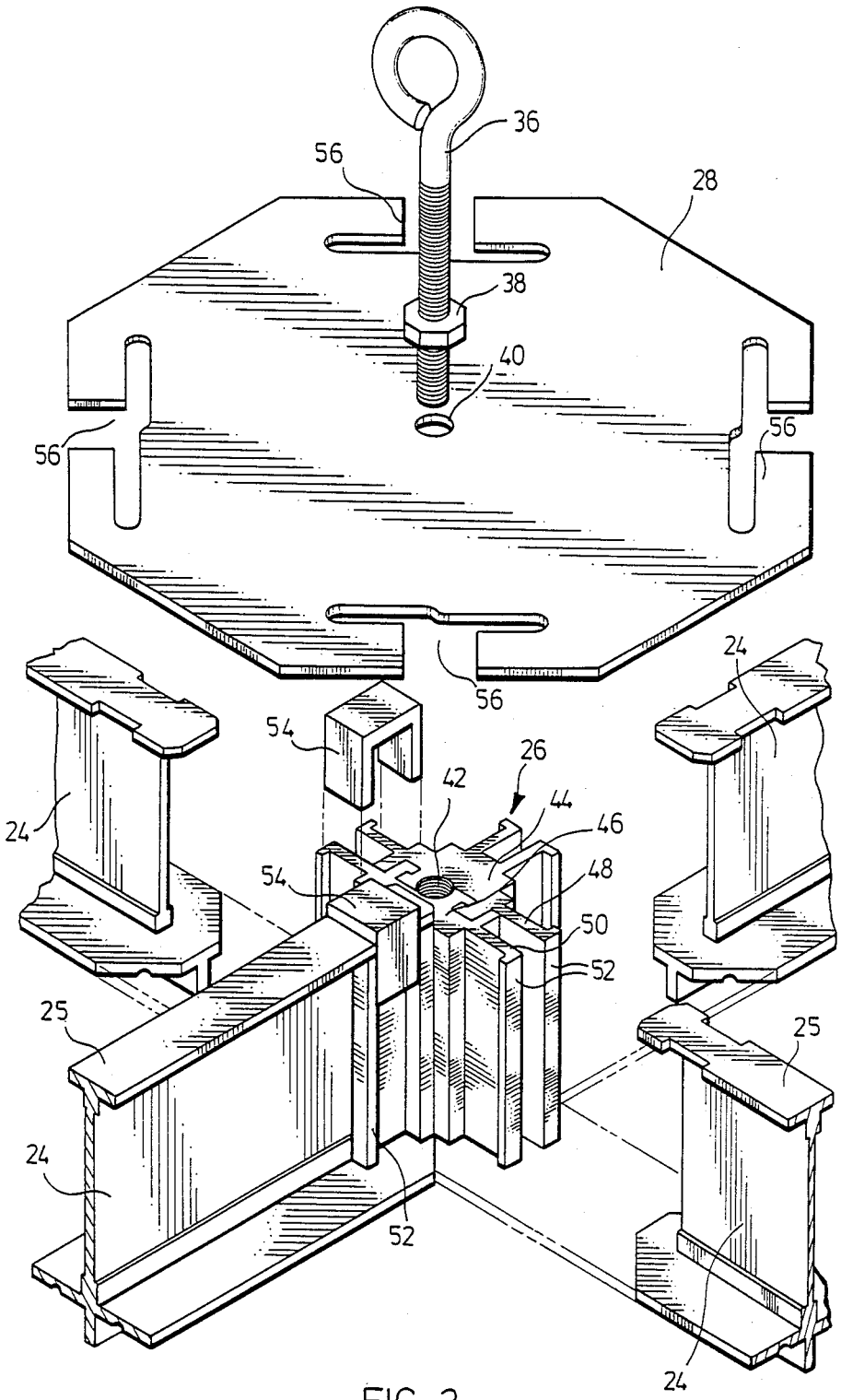
FIG. 2 is an exploded partial perspective view of the junction member and plate used to secure individual structural members of the grid network.

Details of the method of securing the structural members of the grid network within the junction member, can be appreciated by reviewing FIG. 2. The junction member, generally shown at 26, is formed by the two components 44 and 46 slidably engaging one another. These components are preferably extruded and will be made of an aluminum or an aluminum alloy. At the centre of these components is a threaded aperture 42 for receiving the threaded I-bolt 36. Each of the structural members 24 has a notched portion on the upper flange of the sturctural member position adjacent the end thereof to align with the recess provided behind the out turned lips 52 of each of the arms 48 and 50 which define a slot for receiving the web of the structural member. As shown in the drawing, one of the structural members has been secured within the junction member as the U-shaped clip portion 54 overlies the upper flange of the structural member and is received within the recess portion of the structural member and within the slot like recess of the junction member behind the lips 52. In this manner, the structural member is secured to the junction member and cannot withdraw therefrom without removing of the U-shaped clip 54. Four clip members will provided for securing of the four structural members and after these have been secured, the plate member 28 can be secured to the junction member. Securement is provided by having I-bolt 36 pass through the central aperture 40, provided in the plate member, with this bolt subsequently being secured within aperture 41 of the junction member. After the bolt has been properly positioned to control the height of the junction member, and in so doing controlling the height of the grid network, nut 38 provided on the bolt is used to snug the plate against the clips thereby securing the structural members. In this way, pressure is applied through the clips 54 to the upper portions of the structural members thereby positively securing the structural members in the junction member and also positively positioning these structural members by pressing the upper flange 25 against the upper surface of the junction member. Therefore, the position of the height of the structural members within the junction member is accurately controlled and a high degree of precision of the junction member beneath the support steel is possible by adjusting the I-bolt.

The plate member 28 has been provided with recessed areas 56 spaced about the periphery of the plate member and inwardly of the junction member relative to a given cell of the grid network. These recesses are generally positioned to bisect the right angle between any two structural members and will be spaced outwardly of the junction members a sufficient distance to clear the lower flange of the structural members. These recesses are used to receive the legs of a torsion spring used in the securement of the panels beneath the grid network.

Further details, of the suspension of the panels, can be appreciated from FIG. 3 where one panel 2 is shown in snug engagement beneath the grid network and a second panel 2a is shown suspended below the grid network by one corner of the panel, generally perpendicular to the grid network. In this way an installer may grasp a torsion spring, associated with the one corner, lift the panel and suspend it from the grid system by forcing the legs 33 of the torsion spring into the recesses 56 provided in the plate member and the panel will be suspended in this position as the outwardly extending portion 32 of the legs of the torsion spring overlie the top edge of the plate. Therefore, in contrast to prior art systems, the installation of the panels and particularly the securement of the panels beneath the grid system, has been simplified and the installer need only suspend one corner initially and subsequently suspend the remaining corners in preparation for placement of the panels immediately beneath the grid network. One of the reasons that this is possible with the present system, is that each panel has been provided with a reinforced edge as reinforcing members 6 are secured about the periphery of the body member 4 of the panel 2. These reinforcing members have a first arm 10 and a second arm 8 secured to form a generally L-shape with a right angle therebetween. The first arm has an inwardly directing flange member 12 positioned about ¾ of the length of the first arm below the second arm 8. This flange is generally perpendicular to the first arm and parallel to the second arm. These reinforcing members 6 are secured to the body member by providing a kerf in the edge of the body member sized to snuggly receive the flange 12 and an adhesive is applied, whereby the bonding of the flange within the kerf secures the reinforcing member to the panel. These reinforcing members accurately define the top edge of the panel and the perpendicular side edges of the panel, stiffening the panel and reducing deflection of the panel. The body member of the panel is normally made of a fiberglass having a density four to fifteen pounds per cubic foot, although it may be possible to provide a body member of other materials, such as mineral board or wood fiber board. As these reinforcing members are used to control the alignment of the panels and the dimension of the panels with respect to height, they are produced by extrusion in order to narrow tolerance variations. In addition, the body member 2, preferably before the kerf, has been provided the side edge thereof is passed through a belt sander to accurately control the dimension of the body member such that it does not extend below the laterally extending bead 14 of the first arm member. Thus it can be appreciated that the lower edge of the first arm member determines the lower periphery of the panel and therefore, as this reinforcing member is directly in contact with the grid network, accurate control on the lower surface of the ceiling is obtained due to the precision in the extruded components used in the present system. This is in contrast to prior art systems, which do not positively control the height of the ceiling in the manner of the present system.

The second arm of the reinforcing arm is provided with a raised bead portion 19 which is received within a recess 27 in the outwardly extending lower flanges of the structural members 24. This is a sealing bead which allows the panel, in combination with the grid network, to provide a sealed surface wherein the area above the ceiling can be used as a return plenum for a forced air ventilation system.

With respect to FIGS. 3 and 4, the actual securement of the panel to the plate, associated with the junction member, can be appreciated. A corner clip, generally shown as 60, has a thin base plate which is triangular and received beneath the second arm of the reinforcing members to provide a snug fit between the body member 4 of the panel and the second arm of the reinforcing members. This base member is forced under the second arms at the mitered corner of the panel and an upwardly extending torsion spring engaging member 62 is provided for engaging the coiled portion 31 of a torsion spring. In this way a pivot connection is provided between the clip member and the torsion spring to allow suspension of the panels, generally perpendicular to the grid system, from any side of the panel if two torsion springs are selectively disengaged and another two torsion springs remain engaged or to allow suspension of the panel from one corner thereof. The bonding of the flange member 12, within the body member, provides the only securement of the reinforcing members to the body, although further adhesives could be applied, however these have not proven necessary in most applications. This arrangement provides a very simple method for reinforcing the edges of the panels to protect them from damage and also simplifies the securement of panels beneath the grid network.

In FIG. 3, it can also be seen that a decorative cover member 16 has been secured to the lower surface of the body member by an adhesive and is applied about the lower edge of the first arm of the reinforcing member. This decorative cover, which is preferably made of cloth or other sheet goods, is cut on the first arm member 10 at position 18 below the alignment stud 29 of the grid network and the cloth is compressible and assists in concealing the alignment stud when two panels are secured beneath the grid network. In addition to concealing of the alignment lug, the laterally extending bead portion 14, of the first arm, provides a point of line contact for abutting panels to thereby simplify alignment and interengagement of the panels. The alignment stud 29 accurately aligns the panels both in the length and width of the ceiling system due to cooperation of the reinforcing members and this stud. Concealing of the stud is provided by the abutting beads 14 at the lower edge of the panels which is much easier to maintain than assuring abuttment along a substantial portion of the first arm member. This engagement is further simplified as the decorative cover is somewhat compressible thereby assuring full concealment of the alignment stud 25.

Turning to FIGS. 5 and 6, it can be seen how the laterally extending bead of the first arm accurately determines the lower surface of the panel and therefore, the lower surface of the ceiling system is accurately determined as the reinforcing member beneath the grid network is determined by the interaction of the reinforcing member and the structural members of the grid. As previously mentioned, the main reason for this is that the body member 4 of the panel is of a thickness to lie within the reinforcing members and the periphery of the panel is accurate due to the extruded reinforcing members. This is important in that the abutting edges of adjacent panels are essentially at the same position and therefore minor variations across the width of the panel would not be detected as they are corrected at the edge of the panel. For example variations in excess of 1/16th of an inch are not acceptable. The precision required is approximately 1/16th of an inch variation at the abutting edges of panels and the deflection across a length of a panel is limited to 1/360th of the span or less. The size of the panels generally used with this system are 5 feet by 5 feet or less and larger than about 2 feet by 2 feet. If larger panels are used, intermediate support is provided between corners of the panel in order to maintain the precision. Such support can be provided by mounting a sliding member on the top rail of the grid member slotted in a manner to receive the legs of a torsion spring either side of the grid member.

In FIG. 6, one reinforcing member 6*a* has been secured to the body member 4 and a second reinforcing member 6*b* is about to be applied to the body member with the flange 12 being received within the kerfed recess 29. An adhesive is applied to the flange 12 to provide an intimate bond of the body member adjacent the kerfed recess with the flange 12. In this manner, the reinforcing member is firmly secured to the body member and stiffens the panel. The particular placement of the flange, at approximately ¾ of the distance below the second arm 8 of the reinforcing member, is important in that it provides a substantial portion of the body member below the kerfed recess 29, thereby avoiding problems due to cracking of the body member in the cutting operation and it also serves to increase the moment of inertia of the reinforcing member to reduce deflection of the panel. It is therefore preferable, to place the inwardly directing flange 12 as close to the lower surface of the body member as possible without causing problems during deflection of the panel or cutting of the panel to receive the flange. The greater the distance of the flange below the second arm the higher the moment of inertia of the reinforcing member. As mentioned, it has been found that with a panel of a thickness between ½" and 2" with the body member made of a fiberglass having a density in the range of four to fifteen pounds per cubic foot, that the flange can be placed approximately ¾ of the length of the first arm member below the second arm.

The decorative cover 16, is shown secured to the panel of FIG. 5 and in FIG. 6 is shown in preparation for securement. Once the structural member 6*b* has been secured to the body member, the cover can be applied to the lower surface of the panel and secured thereto by an adhesive applied to the entire cover member. The first arm of each reinforcing member is provided with a small recess 17, whereby the cover member, when applied about the panel, may be cut by passing a knife through the cover member using the recess 17 as a guide. In this manner the cover is terminated below the position of the alignment stud when a panel is secured beneath the grid network and a sufficient side edge of the cover is provided to tightly secured the cover to the refinforcing members. This aspect is important, as the cover is used to conceal the alignment bead and good adhesion of the cover adjacent the laterally extending bead 14 is preferred.

Figure 7:
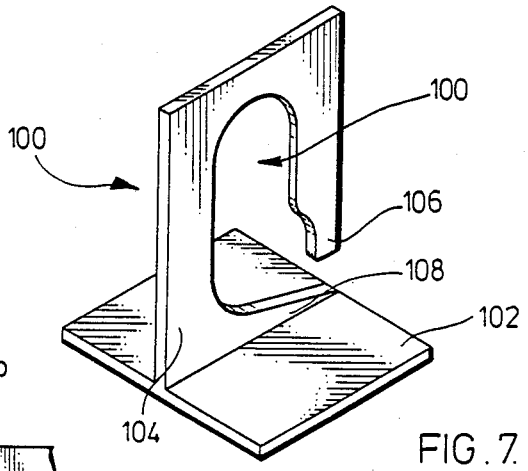
FIG. 7 is a perspective view of a modified corner clip used for suspending of panels.
Figure 9:
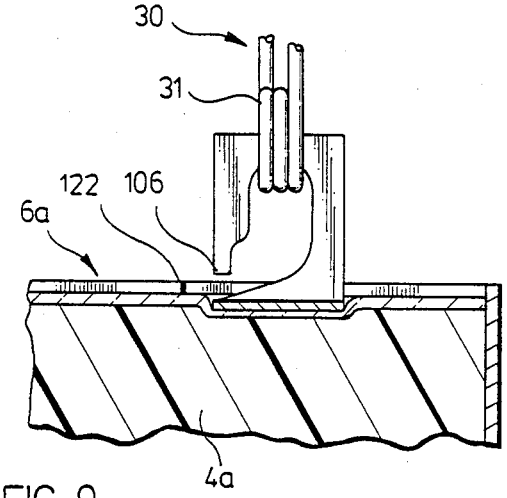
FIG. 9 is a sectional view along lines 99 of FIG. 8.

A modified corner clip member is shown in FIG. 7 which can be made from an extruded aluminum T-bar which is subsequently been punched to define an opening 110 for securing the torsion springs generally as shown in FIG. 9. The modified clip generally shown as 100 in FIG. 7 includes a flat base member 102 from which the upright perpendicular member 104 extends. A gap is provided to allow the coil of a spring clip to be engaged as the coil can pass through the gap defined between the ramp member 108 and the end portion 106 of the engagement portion.

Figure 8:
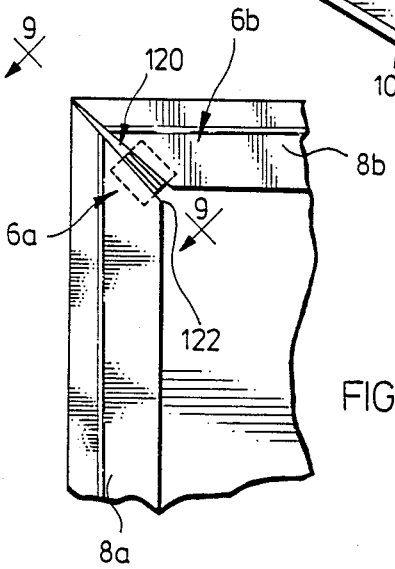
FIG. 8 is a top view of a corner of the panel with a modified clip secured to the panel.

As shown in FIGS. 8 and 9 the clip member may be secured at the junction of two reinforcing edge members 6*a* and 6*b* at the corner of the panel. These top edge members in addition to being mitered at the outside edges thereof have a slightly wider gap generally shown as 120 to allow the clip to secure beneath the upright members with the perpendicular member 104 extending up through the gap 120. As shown in FIG. 9 the fiber body 4*a* has been locally deformed in the immediate area of the clip and this fiber member serves to retain the clip in snug engagement beneath the upper edges 8*a* and 8*b* of the reinforcing members. Furthermore it can be seen that the slot 120 is of a sufficient depth such that the clip member is contained within the area generally defined by the reinforcing edge members such that the end portion 106 when secured to a panel is above the reinforcing members and inwardly of the edges thereof. In this manner the gap defined between 106 and 108 which was of a sufficient width to allow a coil of a torsion spring to enter therebetween has now been decreased by the thickness of the reinforcing members such that the coil spring can not be accidently removed. As can be appreciated this provides a very simple system for maintaining this spring within the clip. Furthermore the reinforcing members now contact the upright edge 104 of the clip and assure that the clip is maintained at the corner and cannot slide longitudinally along the length of one of the edge members. This modified clip in combination with the modified top reinforcing edge members is preferred to the system generally as shown with respect to FIGS. 3 and 4.

A somewhat simpler arrangement for securing of the structural members 24*a* at an intersection thereof by using the junction members 200 having a body portion 201 and a top plate 28*a*. As can be seen, the body portion is closed on the bottom thereof and has an upwardly extending socket 202 for receiving the threaded I-bolt 36*a*. This I-bolt again passes through a central aperture 40*a* in the modified top plate 28*a* and applies a downward pressure on the structural members 24*a* to maintain securement of these members within the junction member. In contrast to the system shown in FIG. 2, the top plate 28*a* and the body member 201 may be secured by use of the I-bolt 36*a* and the associated nut 38*a* prior to securing of the structural members 24*a* therein. As can be seen, the plate 28*a* has been provided with apertures 208 for cooperating with pins 206 of the body member. In this way the orientation of the plate as secured to the body member 201 is predetermined. Once the plate has been secured to the body, by having the I-bolt engaged to socket 202 with the nut 38*a* being snug against the top plate 28*a*, the locking tang members 230 will be aligned with the slot defined by arms 204 provided to the outside of the junction member which receive the web 24 of the structural members. The structural members 24*a* may then be inserted into the junction member and will be retained in the slot between arms 204 due to the tang members 230 with their downward projection 232 being in engagement with recess 150 of each of the structural members. As can be appreciated, downward projection 232 provides a camming surface to allow assembly of the structural members and the opposite face assures the structural members are locked within the junction member in a manner to prevent inadvertent withdrawal.

The structural members contact the portions of the body member between the arms 204, these portions act as stop faces for the structural members.

Figures 10, 11:
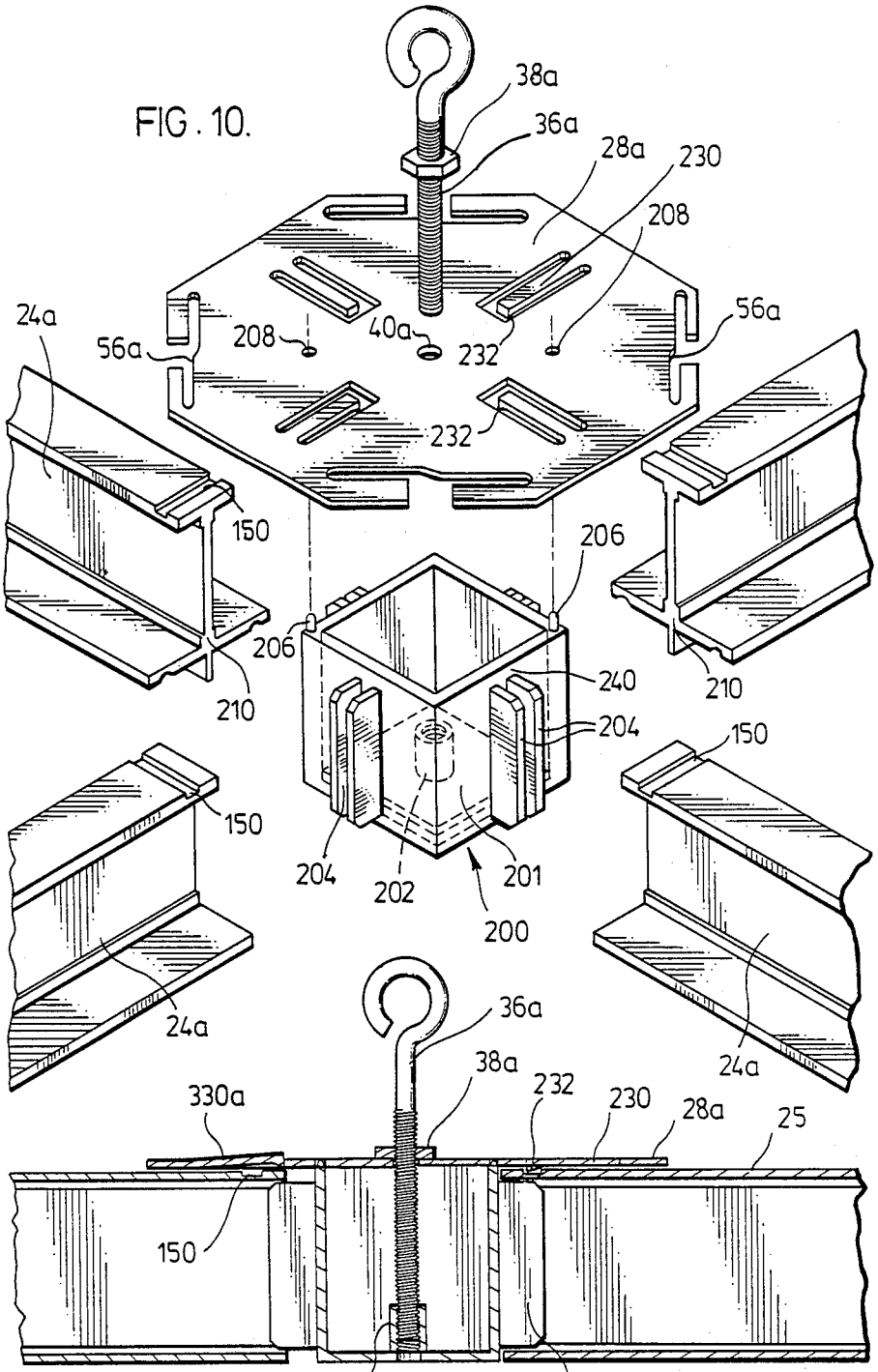
FIG. 10 is an exploded perspective view of a modified method of connecting the structural grid members at a junction.
FIG. 11 is a vertical section through the modified junction member when securing structural grid members.
Figure 12:
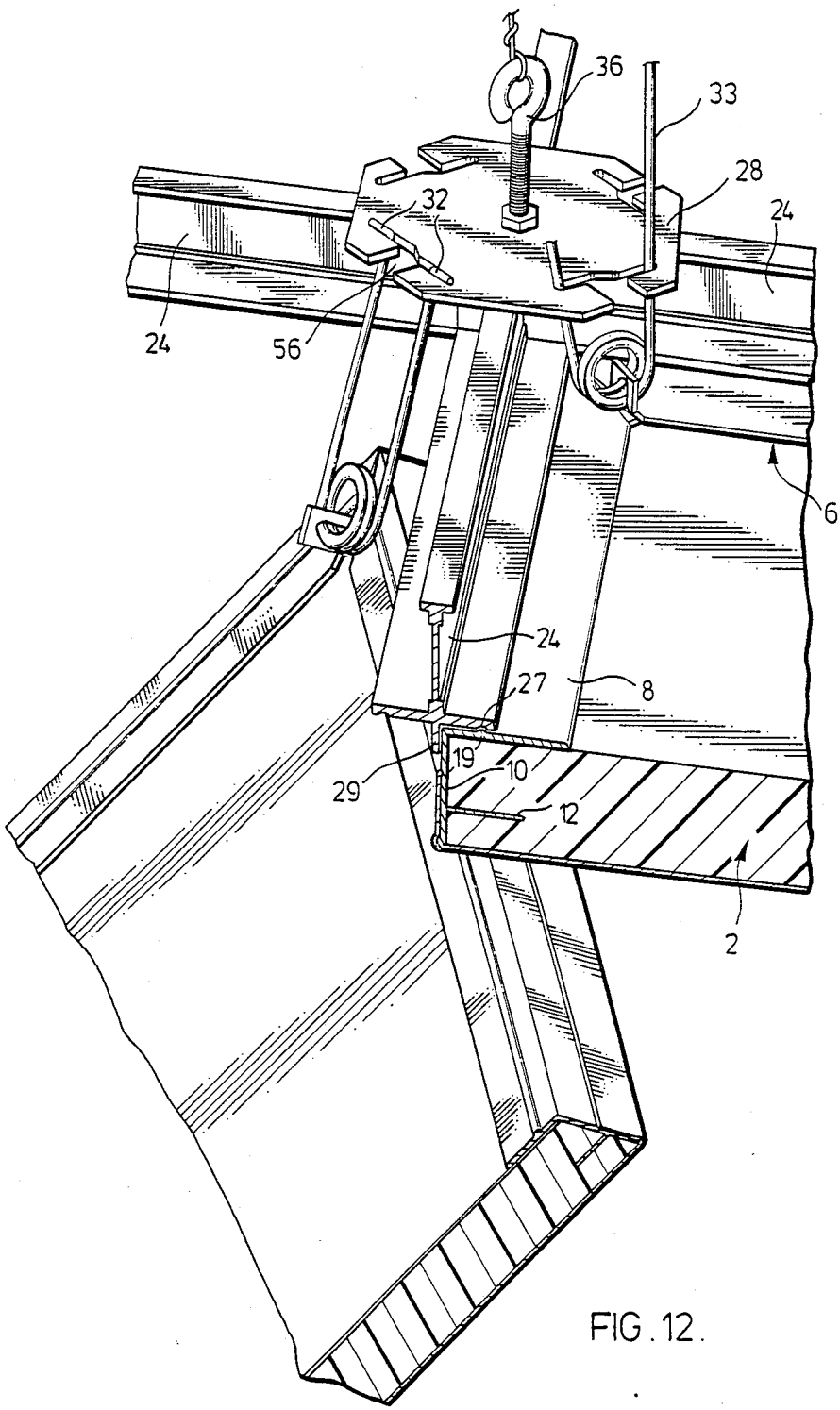

The assembled structure can be seen in FIG. 11 where one of the structural members has been secured within the junction member and a second member is about to be secured by longitudinally inserting of the structural member. This tang member 230*a* is shown projecting above the normal plane of the plate 28*a* as it has not yet become engaged within the transverse groove 150 of the structural member. As described in reference to the earlier figures, fine adjustment of positioning of the junction member is possible as the socket 202 is of a sufficient height to maintain the I-bolt 36*a* at various positions and can be locked in this position by tightening of the locking nut 38*a*.

With this modified construction of the junction the structural members are cut to provide a different end portion generally shown as 210 where the faces of the structural members are perpendicular to the longitudinal axis thereof. This is a much simpler structure to produce relative to the more complicated end configuration required with the system as shown in FIG. 2. In contrast to the grid network shown in FIG. 2, the body portion of the junction member of FIGS. 10 and 11 is preferrably integrally cast of a zinc or aluminum alloy.

With the modified clip member of FIG. 7 and the modified reinforcing edge members of FIG. 8 and the improved junction member of FIGS. 10 and 11, installation of the system in the field is greatly simplified and problems such as longitudinal movement of the clip members, and difficulty in assembling the grid network are overcome. This system also allows very positive securement and placement of the grid members at the junction point as the upper edges 25 of the structural members are pushed against the upper edges slot 204 by the plate member 28*a* due to the pressure being applied by the nut 38*a* and exact positioning of the junction member beneath the support steel is easily achieved due to the fine adjustment provided as previously discussed. For these reasons, the system as generally shown in FIGS. 7 through 11 is preferred.

The present system provides a very accurate suspended ceiling system where the height of the lower surface of the ceiling system can be accurately maintained while realizing the benefits of forming the ceiling by using a plurality of ceiling panels. The ceiling panels require the reinforcing edge members, about the periphery thereof, which stiffen the panel and determine the lower surface of the panel particularly at the abutting edges of adjacent panels. This structure reduces light variations which occur when the ceiling system has vary heights. This system also simplifies alignment of the panels both in the length of the grid network as well as the width thereof. This is obviously important as the abutting edges do form a characteristics of the finished ceiling and this effect can be minimized if the lines are essentially straight as opposed to wandering about a straight line. Suspension of individual panels, particularly during installation, although it can also occur should access to the area above the ceiling be required, is simplified and the panels can be suspended from a corner thereof generally perpendicular to the grid network. The grid network is provided with junction members at each individual cell of the grid network which secure and accurately position the structural members of the grid in a predetermined fashion and also directly support the panels. In this manner, it is only necessary to adjust the height of the junction members and a very accurate grid system can be provided. This accuracy is translated to lower surface of the ceiling due to the extruded reinforcing edge members secured about each panel which abut the grid system in the finished form.

Although various preferred embodiments of the present invention have been described herein in detail, it will be understood by those skilled in the art, that variations may be made thereto without departing from the spirit of the invention or the scope or the appended claims.

The embodiments of the invention in which an exclusive property or priviledge is claimed are defined as follows:

1. A ceiling panel for use in a suspended ceiling system to define an essentially horizontal ceiling surface, said ceiling panel comprising a body member of acoustical dampening material have at least one essentially planar surface, said body member having straight side edges generally perpendicular to said planar surface which define the ceiling panel periphery, generally "L" frame members secured to the side edges of said body member to overlie a portion of a top surface of said panel and abutting the side edges thereof, each of said frame members including an inwardly directed planar projection snuggly received within a kerf provided in the side edge of said body member, said frame member being bonded to said body member by an adhesive whereby said frame member when secured to a body member cooperates with said body member to stiffen said panel.

2. A ceiling panel as claimed in claim 1 wherein the adhesive securing said body member and said frame member secures said projection and said kerf.

3. A ceiling panel as claimed in claim 2, wherein said panel is of generally constant thickness and said inward projection is located approximately $\frac{3}{4}$ the thickness of said body member below the top surface of said panel.

4. A ceiling panel as claimed in claim 2 wherein said body member is made of fiberglass having a density of 4 to 15 pounds per cubic foot.

5. A ceiling panel as claimed in claim 1 or 2, wherein each of said frame members is extruded and extends down the side of said body member and terminates at a lower surface of said at least panel surface, whereby the top surface and the lower surface of said panel are determined by said frame members.

6. A ceiling panel as claimed in claim 2, 3, or 4, wherein a lower surface of said panel has a sheet good covering adhered thereto and secured to at least a portion of each frame member on the sides of said panel.

7. A ceiling panel as claimed in claim 2, wherein said body member is presized to accurately define said planar surface relative to said kerfed recess whereby said planar surface is essentially co-planar with the plane defined by lower most edges of said first arms of said frame members when secured to said body member.

8. A suspended ceiling system as claimed in claim 7, wherein each of said torsion springs are secured to a panel by a clip slidably received and maintained by a friction fit between the top of said reinforcing edge and said body member, said clip including a spring retaining portion for engaging the central coil of one of said torsion springs inwardly of the edge of said panel.

9. A suspended ceiling system as claimed in claim 8, wherein said panels are rectangular and have four torsion springs secured to said panel by said clips at the corners of said panels, said grid system independently supporting each panel whereby each of said panels may be lowered and said torsion springs can be selectively disengaged from said grid system to allow hanging of said lowered panel generally perpendicular to said grid system along any edge of said panel or from any corner thereof.

10. A suspended ceiling system as claimed in claim 8 or 9, wherein each of said panels is covered by a cloth fabric secured by adhesive to the lower surface of said body member and the side edge of said reinforcing member, said reinforcing edge including a laterally outwardly extending bead at the lower surface of said body member which in combination with the other reinforcing edges determines the lower plane of the combined body member and reinforcing edges, each laterally extending bead providing the contact position for abutting panels and assist in concealing the supporting grid members, said grid members and said reinforcing edges all being extruded, and each said reinforcing edge cooperating with said grid members whereby the position of the lower surface of said panels is determined by the precision of said grid members and said reinforcing edges, whereby the abutting edges of two adjacent panels are essentially at the same position below said grid members, thereby greatly reducing any perceived variation in the height of the ceiling system.

11. A ceiling panel as claimed in claim 2 including a clip for hanging of said panel beneath a grid support network generally at the corners of said panel, each clip having a generally planar thin upright portion adapted to receive and retain a central coil of a torsion spring adjacent one end thereof and the other and including a frame engaging portion generally perpendicular to said upright portion, said frame members cooperating or including a narrow slot open to the interior of said panel and ending before the edge of said panel longitudinally receiving said thin upright portion with said frame engaging portion being received between said at least frame member adjacent the slot whereby movement of said clip when secured to a panel is limited by said upright portion and the slot of the frame member such that longitudinal sliding of said clip along a frame member is eliminated.

12. A ceiling panel as claimed in claim 11 wherein the upright portion of said clip is hook shaped for receiving the central coil of such torsion spring by inserting the coil into the hook shape between said frame engaging portion and the hook shape of said upright, said clip being received in the slot of said at least frame member whereby the frame member lies between said hook shape and said frame engaging portion whereby said coil portion is locked in the hook shaped upright portion.

13. A ceiling panel as claimed in claim 2 wherein said body member is of an essentially resiliently compressible material and said frame members are secured about said body member and generally abut at the corners defined by the adjacent sides of said body member, the portion of said 'L' shaped frame members overlying said top surface being cut to generally abut adjacent the corner of body member and diverge slightly to provide a narrow slot open to the center of the body member, and a clip for engaging said frame members and securing the central coil of a torsion spring having two outwardly extended legs, said clip being generally 'T' shaped in cross-section defined by a generally planar member and a perpendicular extending web secured generally centrally to said planar member and adapted to secure said central coil, the narrow slot defined at the junction of said 'L' shaped members being of a width to longitudinally receive the web of said clip such that the plane of the web is generally parallel with the slot with the planar member of said clip being received between said body member and said frame members by locally compressing said body member which maintains pressure on said planar member urging it against the frame members, whereby movement of said clip away from said frame members or in the longitudinally direction of one of the adjacent frame members is limited.

14. A ceiling panel for use in a suspended ceiling system to define an essentially horizontal ceiling surface, said ceiling panel comprising a rectilinear flat body member having a periphery and a thickness between about half an inch to two inches, a plurality of extruded aluminium members applied about the periphery of said body member, said body member being kerfed about the periphery intermediate top and bottom surfaces of the panel to define a recess generally parallel to the bottom surface of the body member, each extruded aluminium member having a first arm and a second arm secured to form a right angle, said first arm including a thin inwardly directed flange means generally parallel to said second arm, whereby said members when applied to the periphery of said body member are secured thereto by an adhesive securing said flange within said kerf in a manner such that said first arm is in engagement with the periphery of the body member and the second arm overlies and is in contact with the top surface of the body member about the periphery thereof.

15. A ceiling panel as claimed in claim 14, wherein said first arm includes a small indentation extending the length of said extrusion and said panel includes a sheet goods cover secured by an adhesive to the bottom surface of said body member and to the first arm of said extruded members, said indentation providing a guide to facilitate cutting of said applied sheet goods cover.

16. A ceiling panel as claimed in claim 15, wherein said first arm extends down the edge of the body member and defines at least in part a lower edge of the body member, in that a bead portion is provided on said first arm at the lower edge of said body member and extending outwardly thereof.

17. A ceiling panel as claimed in claim 1, wherein said body member is of a thickness to lie within the frame members and the bottom surface of said body member is approximately co-planar with a plane defined by lower most edges of the first arms of said frame members.

18. A suspended ceiling system comprising a plurality of grid support members, a plurality of ceiling panels having a body member and a reinforcing edge secured about the panel and overlying a top edge of the panel and extending down a side edge thereof, spring means hingedly secured to each of said panels and releasably secured to one of said grid members, wherein said spring means maintains said panel in position against said grid members in one position and in a second position said spring means is selectively disengagable for suspending a ceiling panel generally perpendicular to said grid members, said reinforcing edge including a thin inwardly directed flange means generally parallel to a top surface of the panel received within a kerfed recess in the edge of said body member, said reinforcing edge being secured to said body member by an adhesive securing said flange means and said body member within the kerfed recess.

19. A suspended ceiling system as claimed in claim 18, wherein said reinforced edge extends fully down the edge of said body member and has a laterally extending bead adjacent the lower edge of the body member to determine a contact bead area between adjacent suspended ceiling panels.

20. A suspended ceiling system as claimed in claim 18, wherein said spring means includes a plurality of torsion springs spaced about the periphery of said panels.

21. A suspended ceiling system as claimed in claim 19, wherein said grid members have a downwardly extending alignment stud which cooperates with the reinforced edge of said panels to accurately align panels with the grid members when positioned thereagainst, said panels including a decorative cover on a lower surface of the panel which extends upwardly along the edges of the panel, whereby when two adjacent panels are secured to the grid members the alignment stud therebetween is not visible due to the decorative cover of said panels extending upwardly along the edges thereof.

22. A suspended ceiling system as claimed in claim 21, wherein said decorative cover is made of a compressible sheet goods having a thickness such that said laterally extending bead is fully concealed by two abutting panels in said one position.

23. A suspended ceiling system as claimed in claim 18, wherein said grid members are extruded and include lateral extending means for abutting with the top edge of said reinforcing edge members which are also extruded, said body members being dimensioned to lie within the frame defined by reinforcing members whereby the position of lower surface of the panel is determined by said grid members and said reinforcing edge members.

24. A suspended ceiling system comprising a plurality of ceiling panels and a plurality of structural members arranged in a grid-like manner to cooperatively support and accurately position said ceiling panels, said panels including a body member having a lower planar surface and a reinforcing edge means which accurately defines side edges and an upper peripheral edge of each of said panels, each panel being faced with a sheet material which extends across the lower planar surface of said body member and is secured to the side edges of said panel, said structural members having upper and lower portions with said lower portion having a flange and a downwardly extending alignment stud generally centered with respect to said flange, securement means associated with said reinforcing edge member and the upper portion of said structural members for fastening said panels in place beneath said structural members, said edge means cooperating with said alignment stud to align the side edges of adjacent panels and said flange cooperating with said reinforcing edge means to position the panels beneath the grid members a predetermined distance, said reinforcing edge means including an inwardly directed flange received in a kerfed recess in the edge of said body member, said flange being in secured engagement with said kerfed recess to thereby secure said reinforcing edge means to said body member.

25. A suspended ceiling system as claimed in claim 24, wherein said body member is of an acoustical dampening material and said reinforcing edge member has two arms generally perpendicular to one another to define a generally L-shaped cross-section for bounding the upper edge of the panel along the top and side thereof, the arm along the side edge of the panel including an inwardly directed portion for positively engaging said body member, said securement means including a torsion spring and a clip, said torsion spring having two extending leg portions with tabs at the ends thereof and a central coiled portion which is engaged by said clip, said clip cooperating with the free end of the arm extending along the upper edge of the panel for securing said panel beneath said structural members.

26. A suspended ceiling system as claimed in claim 24, wherein said securement means includes clip members slidably received between said reinforcing edge member adjacent the corner of said panel and fixed thereto and a torsion spring associated with each clip whereby a panel may be hung beneath said structural members by any one clip and torsion spring during installation of the panel.

27. A suspended ceiling system as claimed in claim 24, 25 or 26, wherein said flange of said structural member and the arm of said reinforcing edge member cooperated to seal along a bead of one of these components which is received in a recess of the other component, said securement means providing a positive pressure urging said structural member and said reinforcing edge member into abutting contact.

28. A suspended ceiling system as claimed in claim 24, wherein said sheet material is positioned below said alignment stud when a panel is positioned below said structural members and is of a thickness such that adjacent panels cover said alignment stud when viewed from below said ceiling panels.

29. A suspended ceiling system as claimed in claim 24, wherein said structural members define a grid having a spacing corresponding to the size of said panels, said securement means including a plate member associated with individual intersection points of the grid, said plate member including four slots each for receiving the legs of a torsion spring hingedly secured to a corner of a panel, said slots being arranged radially outwardly of the junction point and spaced about the junction point whereby each slot is located between two different perpendicular structural members, said plate member providing a bearing surface for securing said structural member together at the junction thereof to accurately located said structural members relative to one another both in angular orientation as well as distance below said plate member.

30. A suspended ceiling system as claimed in claim 29 wherein said structural members are secured by junction members to define a grid system, each junction member having four vertical slots each defined by a pair of parrallel arms spaced for snuggly receiving and securing a structural member, each of said junction members having means for receiving a threaded bolt which passes through said plate member and including means associated with said bolt for securing said plate member and said junction member in an adjusted position.

31. A suspended ceiling system as claimed in claim 30, wherein said means is a nut threadingly secured to said bolt.

32. In a suspended ceiling grid support network for supporting and accurately positioning ceiling panels, the network being defined by a plurality of structural members having a top flange, a perpendicular web and a lower flange, said structural members being interconnected by junction members to define the grid network, an improved junction member comprising a top member for at least partially overlying the top flange of structural members, a lower body member having a plurality of stop faces extending generally downwardly from and perpendicular to said top member, each of said stop faces haiving a pair of parallel arms perpendicular to said planar top member and spaced downwardly from said planar member a distance to allow a top flange of a structural member to be snuggly received therebetween, said arms being relatively spaced to snuggly receive the web of a structural member, said top member including detent means associated with each of said pairs or arms which cooperate with a structural member to positively secure such structural member in said junction member when slidably inserted between a pair of arms and said top member.

33. In a suspended ceiling grid support system as claimed in claim 32 wherein said lower member is cast and includes four planar faces extending perpendicularly below said top member to define said stop faces, said planar faces being interconnected to form a rectangular section.

34. In a suspended ceiling system as claimed in claim 32, said lower member including a central socket for receiving a threaded bolt in a manner whereby the axis of said bolt is parallel to said stop faces and said bolt extends through and above said top member, a nut secured on said bolt above said top member to maintain said top member tightly secured to and in a fixed position relative to said lower member, whereby said bolt can be adjusted to vary the position thereof by threading said bolt in said socket and said nut can subsequently be tightened against said top plate to secure said top plate and lower member such that the position of said junction beneath support steel to which it is to be secured can be varied by adjusting said bolt.

35. In a suspended ceiling grid network for supporting and accurately positioning ceiling panels, the network being defined by a plurality of structural members each having a top flange, a central perpendicular web and a lower flange parallel to said top flange, and interconnected and supported by junction members, each junction member comprising a top planar surface for overlying at least a portion of the top flanges of structural members and a body portion for receiving at least the web of a structural member to determine the lateral position thereof and to urge the upper flange into abutment with the top planar surface thereby accurately fixing each structural member received within a junction member and means for locking such structural members slidably received in said junction members whereby proper positioning of junction members beneath the support steel accurately determines the elevation and position of the structural members supported by such junction members.

36. In a suspended grid support network as claimed in claim 35 wherein said body portion is cast of a zinc or aluminium alloy and includes two parallel arms for receiving each structural member, said arms being relatively spaced to snuggly receive the web of a structural member and spaced downwardly of the top planar surface to snuggly receive the top flange of such structural member.

37. In a suspended ceiling grid network as claimed in claim 36 wherein said body member is adapted to slidably receive and position four structural members in a rectilinear grid network and said body member includes a centrally disposed socket for threadingly engaging a bolt such that the axis thereof extends generally perpendicular to and through said top planar surface, said bolt allowing fastening of said junction and fine adjustment of the vertical position thereof by turning said bolt in said central socket.

38. In a suspended ceiling grid network as claimed in claim 37 wherein said top planar member is a separate plate secured to said body member and includes, associated with each pair of arms, a downwardly extending spring biased projection shaped and positioned to cam upwardly during sliding insertion of a structural member and lockingly engage within a recess in the top flange of the structural member.

39. In a suspended ceiling grid network as claimed in claim 38 wherein said top planar member includes a torsion spring engaging aperature located between each of said pairs of arms and outwardly of said body member to allow securement of ceiling panels to junction members.

40. In a suspended ceiling system as claimed in claim 39 wherein said torsion spring engaging apertures interrupt the periphery of the top planar member to allow the legs of a torsion spring to be radially inserted into said apertures and said downwardly extending spring biased projection includes a spring arm integral with the top planar member and secured to said member adjacent the edge thereof to extend radially inwardly within an aperture of the planar member and said planar member including alignment apertures for cooperating with at least one projection on said body member to determine the position of said planar member on said body member such that said spring ams are located above said pairs of arms for receiving a web of a structural member.

41. In a suspended ceiling system as claimed in claim 40 wherein ceiling panels are directly supported by junction members and wherein said structural members determine the lateral and vertical position of such panels.

42. A suspended ceiling system comprising a grid network of support members and a plurality of ceiling panels individually supported below said grid network, said support members being spaced such that a grid members are generally directly above at least two opposite side edges of a panel when supported below said grid network in a manner to define a portion of the ceiling, each panel including at least two pairs of torsion springs, each pair pivotally secured in spaced relationship on an upper surface adjacent one of said opposite edges of said panel and releasably securably to said grid network adjacent one of said spaced grid members, each of said panels being supportable beneath said grid network in at least the following positions; a first position with said spring means providing a bias force urging said panel into abutting contact against said grid network to form a portion of said ceiling system, a second position with said spring means spacing said panel below said grid network and generally parallel thereto, and a third position with said panel hanging generally perpendicular to and spaced from said grid network, the support of said panels beneath said grid network simplifying initial support of said panels beneath said grid network, each of said ceiling panels comprising a body member of acoustical dampening material having at least one essentially planar surface, said body member having straight side edges generally perpendicular to said planar surface which define the ceiling panel periphery, generally "L" frame members secured to the side edges of said body member to overlie a portion of a top surface of said panel and abut the side edges thereof, each of said frame member including an inwardly directed planar projection snuggly received within a kerf provided in the side edge of said body member, said planar projections being bonded to said panels within said kerfed recesses thereby securing said frame members to said panels.

43. A suspended ceiling system as claimed in claim 42 wherein each ceiling panel is rectangular and includes means for securing said torsion springs adjacent the corners of said panels to permit hanging of said panels perpendicular to and spaced from said grid network by one of said torsion springs.

44. A suspended ceiling system as claimed in claim 42 wherein said frame members accurately define a top edge about the panel, side eges of said panel, and the thickness of the panel; said frame members directly contacting said support members to accurately position said panels beneath said support members a distance determined by said frame members.

45. A suspended ceiling system as claimed in claim 44 wherein said frame members include a raised sealing bead inwardly of the side edge of the panel, said support members of said grid network defining a plurality of cells, each cell of a size and shape generally corresponding to a ceiling panel, said support members including recesses for receiving the sealing bead of said panels providing a seal between each panel and the grid network suitable for using the area above the ceiling as a return air plenum.

46. A suspended ceiling as claimed in claim 43 wherein said frame members are cut at the ends thereof to provide a miter-like junction at corners of said panels and define an open slot at interior edges of adjacent frame members, and clip means of a shape to be slidably received within one of said open slots with a portion of said clip retained beneath said frame members and a further portion engaging one of said torsion springs said acoustical dampening material of said body member locally deforming to receive the portion of said clip beneath said frame members.

47. A suspended ceiling system as claimed in claim 43 wherein said ceiling panels are of a size in the range of 2 feet by 2 feet to 5 feet by 5 feet.

* * * * *